US007858931B2

(12) United States Patent
Wiedenbeck

(10) Patent No.: US 7,858,931 B2
(45) Date of Patent: Dec. 28, 2010

(54) METHODS AND DEVICES FOR THE MASS-SELECTIVE TRANSPORT OF IONS

(75) Inventor: Michael Wiedenbeck, Potsdam (DE)

(73) Assignee: GeoForschungsZentrum Potsdam Stiftung des Offentlichen Rechts, Telegraftenberg (DE)

( * ) Notice: Subject to any disclaimer, the term of this patent is extended or adjusted under 35 U.S.C. 154(b) by 314 days.

(21) Appl. No.: 11/913,202

(22) PCT Filed: May 9, 2006

(86) PCT No.: PCT/EP2006/004332

§ 371 (c)(1),
(2), (4) Date: Nov. 29, 2007

(87) PCT Pub. No.: WO2006/119966

PCT Pub. Date: Nov. 16, 2006

(65) Prior Publication Data

US 2009/0194678 A1 Aug. 6, 2009

(30) Foreign Application Priority Data

May 11, 2005 (DE) ..... 10 2005 021 836

(51) Int. Cl.
*H01J 49/40* (2006.01)

(52) U.S. Cl. ..... 250/286; 250/281; 250/282; 250/290

(58) Field of Classification Search ..... 250/281, 250/282, 286, 290
See application file for complete search history.

(56) References Cited

U.S. PATENT DOCUMENTS

| | | | | |
|---|---|---|---|---|
| 5,140,158 | A | 8/1992 | Post | |
| 6,791,078 | B2 * | 9/2004 | Giles et al. | 250/286 |

FOREIGN PATENT DOCUMENTS

| | | | |
|---|---|---|---|
| EP | 1 367 633 | A2 | 12/2003 |
| EP | 1 580 790 | A2 | 9/2005 |
| GB | 2 396 958 | A | 7/2004 |
| GB | 2 403 591 | A | 1/2005 |

OTHER PUBLICATIONS

Willard H. Bennett, "Radiofrequency Mass Spectrometer," Journal of Applied Physics, vol. 21, Feb. 1950, pp. 143-149.
L. Schwager Tung, et al., "Mass, Charge, and Energy Separation by Selective Acceleration with a Traveling Potential Hill," Journal of Applied Physics, vol. 80, No. 7, Oct. 1, 1996, pp. 3646-3655.

* cited by examiner

*Primary Examiner*—Jack I Berman
*Assistant Examiner*—Hanway Chang
(74) *Attorney, Agent, or Firm*—DLA Piper LLP (US)

(57) ABSTRACT

A method for the mass-selective transport of ions, especially in a mass spectrometer, comprises the steps movement of the ions on a movement path on which a plurality of electrodes are arranged, and loading the electrodes with pulse-shaped acceleration voltages under the effect of which the ions experience a mass-dependent change of speed, wherein the electrodes are loaded with the pulse-shaped acceleration voltages such t at target ions with a pre-determined target mass are accelerated along the movement path Furthermore, an ion conductor for mass-selective transport of ions, especially in a mass spectrometer, is described.

19 Claims, 2 Drawing Sheets

METHODS AND DEVICES FOR THE MASS-SELECTIVE TRANSPORT OF IONS

RELATED APPLICATION

This is a §371 of International Application No. PCT/EP2006/004332, with an international filing date of May 9, 2006 (WO 2006/119966 A2, published Nov. 16, 2006), which is based on German Patent Application No. 10 2005 021 836.9 filed May 11, 2005.

FIELD OF THE INVENTION

The invention relates to methods for the mass-selective transport of ions through an ion conductor, methods for the mass-selective detection of ions, especially for the mass-spectroscopic examination of ions, ion conductors for the mass-selective transport of ions and mass spectrometers that are equipped with such ion conductors.

BACKGROUND

The mass spectrometry is a widespread measuring method for the analysis of ion masses that is distinguished by a high sensitivity, specificity, rapidity and economy. Therefore numerous applications of mass spectrometry are known in the basic research and the areas of analytic chemistry, medicine, pharmacy, semiconductor technology, environmental- and hydrocarbon research and characterization of nanomaterials. The mass spectrometry is based in general on a separation of ions as a function of their masses. The following three methods for the mass separation were previously known from the practice.

In the mass separation in a sector magnetic field an ion beam is conducted through a magnetic field in which the ions are guided on flight paths with different radii as a function of the mass-charge ratio. With the mass separation in the quadrupole filter ions are put in oscillation during the movement through a quadrupole ion conductor. The mass separation is based on the fact that certain ions for whose mass-charge ratio a resonance condition has been fulfilled in the ion conductor can pass the ion conductor and reach an ion detector. Finally, ions pass through a drift zone during the mass separation as a function of the flight time (TOF mass spectrometry) with a speed that is a function of the mass-charge ratio. With an ion detector, at first light and during the course of time heavier and heavier ions are detected.

All these conventional methods have the disadvantage that as a rule elaborate equipment with complex control and evaluation procedures are required for the mass separation. For example, for the mass separation in the sector magnetic field high voltages of around 10 kV are frequently used. The separation in the quadrupole filter requires an extremely precise adjustment of the field conditions in the ion conductor. Finally, a TOF mass spectrometer requires the implementation of a complicated time measuring technology. Due to the cited disadvantages the use of the conventional mass spectrometers is still limited. Robust, insensitive mass separation systems that can be routinely used are hardly available in the practice.

A mass spectrometer was described by W. H. Bennett in "Journal of Applied Physics" (vol. 21, 1950, p. 143 ff.) in which the mass separation takes place in an ion conductor with several grid electrodes arranged in series in the direction of movement of the ions. The grid electrodes are arranged in groups of three electrodes each, of which the middle electrode is loaded with a high frequency voltage. This arrangement of grid electrodes is permeable exclusively for ions with a certain mass so that they can be used as mass filter for the mass spectrometry. A disadvantage of this technology is that there is a fixed connection between the adjusted high frequency and the vertical distance of the electrode grids. It can be necessary, as a function of the mass of the ions to be detected, to change the distance between the electrode grids. A further disadvantage results from the fact that the ion conductor described by W. H. Bennett only has a limited mass dependency of the permeability so that the resolution power of the mass separation is limited.

SUMMARY

Aspects of the invention have the objective of indicating improved methods for the mass separation, especially for the mass spectrometry, with which the disadvantages of the conventional technologies are avoided. The mass separation should take place in particular with a lower level of equipment and should have a high mass resolution. Additional aspects of the invention also have the objective of making improved ion conductors available that can be used as mass filters. The ion conductors should have a simplified construction and be easy to control. An objective of the invention is, according to a further viewpoint, to make available improved methods and devices for the mass spectrometry.

These objectives are solved by methods with the features of Claims, 1 and 7, by ion conductors with the features of the claim 10 and by mass spectrometers with the features of the claim 16. Advantageous embodiments and applications of the invention result from the dependent claims.

BRIEF DESCRIPTION OF DRAWINGS

Further details and advantages of embodiments of the invention are described in the following with reference made to the attached drawings.

DETAILED DESCRIPTION

Figure 1:
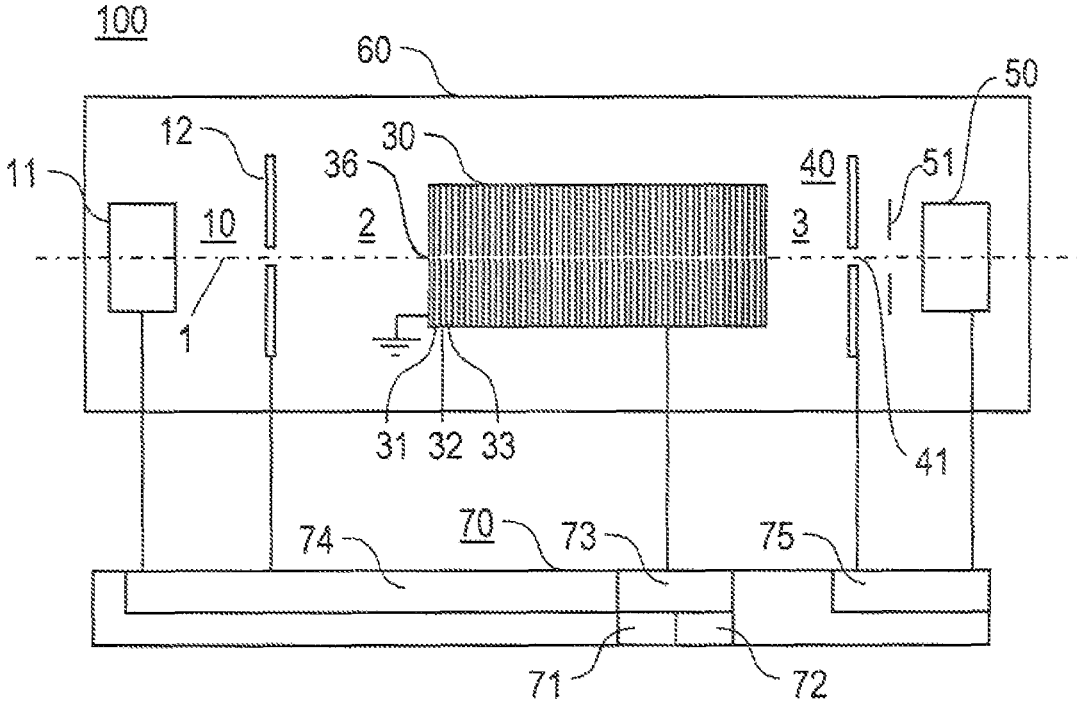
FIG. 1 shows a schematic view of an embodiment of a mass spectrometer in accordance with the invention.

According to a first aspect, an embodiment of the present invention is based on the general technical teaching of moving ions under the effect of electrical fields that are generated with electrodes along the movement path of the ions. The electrical fields are generated in that the electrodes are loaded with pulse-shaped, preferably rectangular acceleration voltages (voltage pulses). Starting from a reference point in time at which the ions are provided and injected with a predetermined kinetic energy into the movement path, each ion passes the individual electrodes after a run time that is a function of the speed and the acceleration of the ion. The speed of the ion is determined by the original kinetic energy when the ions are provided, the mass-charge ratio of the ions and the electrical field effects at the individual electrodes. Accordingly, the acceleration voltages are applied as voltage pulses onto the electrodes in such a manner that exclusively ions that have a predetermined sought target mass (so-called target ions) experience a net gain of the kinetic energy and accordingly an acceleration along the straight movement path. A mass-dependent change of the kinetic energy of the ions takes place. Ions having the target mass are accelerated more strongly than other ions. To this end the amplitudes of the acceleration voltages and/or the duration of the pulse-shaped loading of the electrodes are varied along the movement path. The remaining ions, that have another mass-charge ratio, experience a braking or a significantly lesser energy gain. In distinction to the high-frequency mass spectrometry suggested by W. H. Bennett, the electrodes on the movement path for the linear mass separation are not loaded with a high-frequency voltage but rather with voltage pulses whose starting time and duration are adjustable. The voltage pulses are provided on the individual electrodes with settable cycle times. As a result of the ability to adjust the voltage pulses, a degree of freedom that is not given with the conventional high-frequency technology is achieved that opens up the possibility for an effective and individual electrode control. As a result of applying pulse-shaped acceleration voltages with adjustable phase parameters the target ions can be accelerated with a previously unattained mass selectivity between the individual electrode pairs. Moreover, this concept offers a previously unattained flexibility of switching between several mass-charge ratios of the target ions.

Although, in reality, the speed of the ions along the movement path is a function of the mass-charge ratio of the ions, in the following, only the mass dependency of the speed will be named. This difference is without significance in applications in which all ions carry the same charge. In applications for ions with different charges the adjustment of the voltage pulses is appropriately adapted.

In general, the pulse-shaped acceleration voltages can be provided by voltage pulses applied selectively on the individual electrodes by a pulse generator. However, according to a preferred embodiment of the invention the acceleration voltages are provided by a switching process by means of which the individual electrodes are loaded according to a set time scheme with at least one acceleration voltage.

Preferably, at least one first acceleration voltage is used that acts in an attracting manner on ions when they approach an electrode and is therefore accelerating. The first acceleration voltage can advantageously be provided as direct voltage. It has a sign opposite the charge of the target ions and is continuously applied to one of the electrodes or to an electrode group which the target ions approach during their movement along the movement path.

Alternatively, at least one second acceleration voltage is used that acts on ions in a repelling manner when they depart from an electrode and is therefore accelerating. The second acceleration voltage can advantageously also be provided as direct voltage. It has the same sign as the charge of the target ions and is continuously applied to one of the electrodes or to an electrode group from which the target ions actually depart during their movement along the movement path.

According to a further variant the first (attracting) and second (repelling) acceleration voltages are used in combination so that the mass-selective acceleration is reinforced. If the actual voltage pulse does not only end when the target ions pass an considered electrode but rather turns into a voltage pulse with the opposite sign, an additional energy gain on the electrode can advantageously be achieved by the target ions.

The first and/or second acceleration voltage(s) are preferably generated with a voltage supply apparatus, with a continuous high-frequency switching for the connection of the electrodes which the target ions approach and/or from which the target ions depart being provided with the voltage supply apparatus. In order to achieve the separation effect in accordance with the invention a high-precision switching is preferably implemented.

Advantages relative to an especially effective acceleration exclusively of the target ions can result if the first and/or second acceleration voltages are applied on the electrodes according to a predetermined time scheme in such a manner that a field effect of a currently considered electrode is exerted on an ion when the ion is located at the particular previous and/or subsequent electrode distance. In order to load with the first acceleration voltage the current electrode is connected to the voltage supply apparatus as soon as the target ions are in an electrode distance in front of the previous electrode and until the target ions pass the current electrode. In a corresponding manner the current electrode is connected for loading with the second, repelling acceleration voltage to the voltage supply apparatus in the time interval when the target ions pass the considered electrode until they are at an electrode distance after the considered electrode. Alternatively, the time scheme can be expanded in such a manner that a currently considered electrode is already connected to the first acceleration voltage when the target ions are still in an electrode distance in front of the previous electrode. At this point in time a field effect from the considered electrode is not yet given since the field effect only covers the adjacent electrode distances of an electrode. However, the field effect can advantageously begin immediately during the passage of the target ions through the previous electrode. In a corresponding manner the second acceleration voltage can remain applied on the current electrode until the target ions are at an electrode distance after the following electrode.

According to a preferred embodiment of the invention the pulse-shaped acceleration voltages are applied on the electrodes in such a manner that an electrical potential acting in an accelerating manner on the target ions moves with increasing speed along the movement path of the ions. The time control of the individual electrodes is coordinated in such a manner that the target ions experience a greater net energy gain from this dynamic potential in comparison to all other ions.

A special advantage of the invention is that given a high number of at least 3 electrodes, especially preferably at least 10, e.g., 20, 30, 40, 50 or more electrodes, a maximal transfer of kinetic energy only on the target ions can be achieved. For example, singly charged ions can experience an energy gain of 1000 eV with 201 electrodes and an amplitude of the voltage pulses of +/−5 V. A total energy gain of 2000 eV would even result at the cited combination of the first and second acceleration voltages.

An important advantage of the use of low voltages is that no large voltage gradients occur, so that a gentle examination of organic compounds is made possible. Moreover, no highly stable high voltage sources or electromagnets are needed, so that a mass separation can be economically carried out with a simple construction.

According to an especially preferred embodiment of the invention the electrodes are all connected to a common voltage supply apparatus and in order to apply the acceleration voltages, a continuous switching for the connection of one of the electrodes each time is provided with the voltage supply apparatus. The switching comprises the intermittent connecting of the individual electrodes to the voltage supply apparatus in such a manner that the above-described potential that moves in an accelerated manner is formed. The operation of equipment involved in mass separation is considerably simplified by the continuous switching with a single voltage supply apparatus (or two voltage supply apparatuses).

According to a second aspect, an embodiment of the invention is based on the general technical teaching of providing a method for the mass-selective detection of ions in which at first an ion source apparatus is actuated in order to provide free ions from a sample. The ions are moved with the method in accordance with the invention through an ion conductor comprising the cited electrodes for the mass-selective transfer of kinetic energy onto the target ions. Finally, the ions that passed through the ion conductor are detected with an ion detector apparatus. The advantage of this method is that the mass filter characteristic of the ion conductor can be set by controlling the ion conductor and especially by the timed controlling of the voltage pulses of the individual electrodes.

The selectivity of the detection of ions is advantageously considerably improved if after the transport of the ions through the ion conductor the movement through an energy filter apparatus (braking apparatus) is provided. The ions exiting from the ion conductor comprise the target ions and possibly remaining ions with other masses. Since the target ions differ from the other ions by a significantly elevated energy, a reliable and complete separation can be achieved in the downstream energy filter. Such an energy filter can comprise a braking plate (so-called "retardation lens") or a pair of electrostatic deflection plates with a following mechanical window (so-called "electrostatic analyzer"). The operation of the energy filter is adjusted in such a manner that only the target ions with the elevated energy accelerated on the electrodes of the ion conductor can pass through the energy filter whereas the other ions are retained.

In general, the ion source apparatus can provide ions in a quasi-continuous manner that are transported through the ion conductor. In this general case only the target ions reach the end of the ion conductor with the elevated energy that reach the first electrode of the ion conductor at a suitable point in time. In order to increase the yield and effectiveness of the detection of ions a modified embodiment of the invention provides that the operation of the ion source apparatus and the control of the ion conductor are coordinated in time. A pulse-shaped operation of the ion source apparatus is preferably provided. A reference point in time is set with the actuation of the ion source apparatus after which the accelerating potential runs according to the desired time scheme through the ion conductor with a predetermined delay.

A special advantage of the invention is the use of the mass-selective ion transport in mass spectrometry. According to a preferred variant of the invention the time control of the ion conductor is varied in such a manner that the latter is accelerated successively for different masses. In a corresponding manner, the mass distribution of ions obtained from a sample to be examined can be determined.

According to a further aspect, an embodiment of the present invention is based on providing an ion conductor for the mass-selective transport of ions that contains electrodes in conjunction with a voltage supply apparatus set up for generating pulse-shaped acceleration voltages on the electrodes. In distinction to the conventional high-frequency ion conductor the ion conductor in accordance with the invention has a considerably greater variability when adapting to different ion masses without the distances of the electrodes along the movement path of the ions having to be changed. Furthermore, the ion conductor in accordance with the invention advantageously makes possible a focusing of the energy distribution of the target ions.

According to an aspect of the invention the voltage supply apparatus is equipped with a switching apparatus with which the acceleration voltage(s) from one or two common voltage sources can be continuously applied on the electrodes arranged along the movement path. The beginning and the duration of the acceleration voltage(s) applied on each electrode can be set to the actuation of the switching apparatus that is initiated by a control apparatus. A low voltage source with low power is advantageously sufficient for operating the ion conductor. This makes possible in particular a mobile operation of the ion conductor or of a mass spectrometer equipped with it.

If the voltage supply apparatus is furthermore provided with a synchronization apparatus for controlling the switching apparatus, advantages result for the chronological coordination of the switching apparatus with the operation of an ion source apparatus with which the ions are provided.

If according to an advantageous embodiment of the invention the electrodes of the ion conductor are formed in an essentially areal shape from a conductive material, this can result in advantages for a compact construction of the ion conductor. The electrodes are aligned in parallel relative to each other and perpendicularly relative to the movement path of the ions. They each have a preferably central passage opening through which the movement path of the ions run. It is especially preferable if metallic plates are provided. Alternatively, electrodes in the form of grid nets can be provided.

A mass spectrometer that is equipped with the ion conductor in accordance with an embodiment of the invention represents independent subject matter of the invention. The mass spectrometer is preferably equipped with a detector apparatus such as, e.g., a secondary electron multiplier. The detector apparatus is provided after the energy filter apparatus in the direction of movement of the ions through the ion conductor. An acceleration apparatus is provided with special preference between the energy filter apparatus and the detector apparatus, with which ions can be accelerated to the detector apparatus.

The embodiments of the present invention are distinguished by the following further advantages and features. The mass-selective transport of ions makes possible a mass separation by different kinetic energies of the ions. The variation of the amplitudes of the acceleration voltages and/or of the duration of the pulse-shaped loading of the electrodes along the movement path signifies by the pre-determined energy gain of the target ions a constant acceleration of the "wave" of the pulse-shaped acceleration voltages along the movement path. The target ions preferably experience a constant and/or constantly changing field gradient whereas all other ions pass through a differing gradient that is variable in time. The target ions are accelerated exclusively in one direction (along the movement path). In order to adjust the switching times of the pulse-shaped acceleration voltages (DC low voltages) for each electrode the given knowledge of the geometry of the system and the mass-charge ratio of the target ion are sufficient. Several ions can be separated according to their mass-charge ratios into different target ion groups (so-called multicollection) from an ion group (ion pulse) injected into the movement path. The electrodes are preferably controlled in such a manner that two target ion groups each approach not less than two plate distances inside the ion conductor.

A further aspect of this apparatus is the possibility of conducting ions from several start impulses simultaneously in the ion conductor, which makes possible a significantly elevated cycle frequency. The detection system in accordance with an embodiment of the invention can be operated at a high speed and high frequency range (MHz). The mass separation can take place with an extremely high mass resolution ($M/\Delta M \geqq 200$)

Preferred embodiments of the invention are explained in the following with exemplary reference made to the application in the mass spectrometry. However, the invention can be used not only for the mass separation for the mass spectrometry but rather in a corresponding manner even in other technologies in which there is an interest for a mass-selective filtering or a mass-selective transport of charged particles such as, e.g., in the guiding of ion beams.

FIG. 1 illustrates in a schematic sectional view a mass spectrometer 100 equipped with an ion conductor 30 in accordance with an embodiment of the invention. The mass spectrometer 100 comprises an ion source apparatus 10, the ion conductor 30, an energy filter apparatus 40 and an ion detector apparatus 50 that are arranged in a chamber 60 that can be evacuated and that are connected to a control apparatus 70. The ion source apparatus 10 comprises a particle source 11 and an extraction electrode 12. If the particle source 11 is an ion source, e.g., an electrospray apparatus or a MALDI source, then the extraction electrode 12 serves to release ions in a pulse-shaped manner. If the particle source 11 is a neutral particle source like the one provided, e.g., in the "Sputtered Neutral Mass Spectrometry", then the extraction electrode additionally serves as ionization electrode. Instead of the extraction electrode 12 another ionizer can be provided that is based, e.g., on a pulse-shaped irradiation of neutral particles from the particle source 11. The combination of the particle source 11 and of the extraction electrode 12 can comprise an ion storage apparatus like the one known from the conventional mass spectrometry.

According to a further alternative the ion source apparatus comprises the following three electrodes. At first, a repeller electrode is provided with which charged particles from a sample are accelerated onto the desired movement path. Secondly, an extraction electrode is provided from which charged particles are let through toward the movement path to the ion conductor. Thirdly, a drift zone electrode is provided that limits the drift zone on the sides of the ion source apparatus. A voltage of a few volts above or below the voltage of the extraction electrode is applied in a pulse-shaped manner on the repeller electrode. A direct voltage in a range of, e.g., −50 V to −100 V for negatively charged ions or a corresponding positive voltage for positively charged ions is applied on the extraction electrode. The drift zone electrode is on earth potential like the first electrode 31 of the ion conductor 30.

According to a further alternative the drift zone electrode is omitted. In this case the function of the drift zone electrode is assumed by the first electrode 31 of the ion conductor 30. Finally, according to a further modification no drift zone but rather an acceleration stage with a constant electrostatic gradient is provided.

An ion beam is extracted from the ion source apparatus 10 which beam moves along a movement path 1 with a course corresponding to the reference line shown in dotted line. The ion beam is extracted in a pulse-shaped manner according to a preferred embodiment of the invention. A reference time is set with the actuation of the repeller electrode, the particle source 11 or the extraction electrode 12 with which time the loading of the electrodes of the ion conductor 30 with voltage pulses is coordinated in time.

After the extraction from the ion source apparatus 10 the ions move at first through a drift zone 2. The optionally provided drift zone 2 can be free of electrical gradients or can have a static gradient. For example, a potential of 50 V is provided in the drift zone 2 with a length of, e.g., 20 cm.

The ion conductor 30 comprises a plurality of plate-shaped electrodes 31, 32, 33 . . . (schematically illustrated). Each plate-shaped electrode has a thickness of, e.g., 500 μm and the perpendicular electrode distance between the electrodes is, e.g., 5 mm. The electrodes are insulated relative to one another in that, e.g., an evacuated free space is present in the electrode distances between the electrodes. The electrodes have, e.g., a rectangular or circular form with an extension of, e.g., a few cm. Each electrode has an opening 36 in the middle with a diameter of, e.g., 2 mm. The electrodes are arranged vertically to the movement path 1 in such a manner that the latter runs through openings 36 of the electrodes. Each electrode can be individually controlled. In a corresponding manner, each electrode comprises a separate connection line for the connection with the control apparatus 70 via which the electrode can be loaded with voltage pulses in accordance with the method explained below. The first electrode 31 is preferably on a constant potential, e.g., on earth.

The energy filter apparatus 40 is provided after the last electrode of the ion conductor 30. The distance of the energy filter apparatus 40 (area 3) from the ion conductor 30 along the movement path 1 is, e.g., 1 cm. The energy filter apparatus 40 comprises, e.g., a known retardation lens or deflection plates teat form an energy filter. Ions with sufficiently high energy can pass this energy filter and be detected with the ion detector apparatus 50, that is mounted immediately after the energy filter apparatus 40. In order to avoid an effect on the electrical field in the area of the ion conductor 30 a screening of the retardation lens or of the deflection plate pair or a sufficiently great distance of the energy filter apparatus 40 from the ion conductor 30 is preferably provided. The ion detector apparatus 50 comprises a known detector such as, e.g., a secondary electrode multiplier. The parts 40, 50 are connected to corresponding voltage supplies 75 in the control apparatus 70.

The control apparatus 70 contains a voltage supply apparatus with two low-voltage sources 71, 72, a switching apparatus 73 with which one or more electrodes can be simultaneously connected to one of the low-voltage sources 71, 72, and contains a synchronization apparatus 74 for the timed control of the switching apparatus as a function of the actuation of the ion source apparatus 10.

An acceleration apparatus, e.g., an acceleration electrode 51 for the subsequent acceleration of the ions that have passed the energy filter apparatus 40 can be provided between the energy filter apparatus 40 and the secondary electron multiplier 50. These ions can be accelerated with the acceleration apparatus to an energy above the sensitivity threshold of the secondary electron multiplier 50 (e.g., a few keV). Providing the acceleration apparatus is especially necessary if the ion conductor only supplies an energy below the sensitivity threshold (e.g., a few hundred eV).

The operation of the ion conductor 30 for the mass-selective transport of ions comprises the procedure illustrated in the following. At first, ions are started from the ion source apparatus 10 with a switchable voltage field or neutral particles by a brief, pulse-shaped ionization (ionization, e.g., with electrodes or photons) at the reference time and conducted in the field-free drift zone 2. For positively charged ions, e.g., a voltage of −50 V relative to the extraction electrode 12 is on the first electrode of the ion conductor 30. In a preferred variant of the invention in the case of positively charged ions the entire ion source apparatus 10 with the extraction electrode 12 is on earth at a positive voltage and the first electrode of the ion conductor is on earth. Upon actuation of the ion source apparatus 10 a reference signal is given to the synchronization apparatus 74, with which the switching apparatus 73 is controlled for loading the electrodes 31, 32, 33 . . . with voltage pulses. An accelerating voltage pulse must be applied to each electrode at the point in time when the ions with the desired mass-charge ratio (target ions) are located in front of the appropriate electrode.

Figure 2:
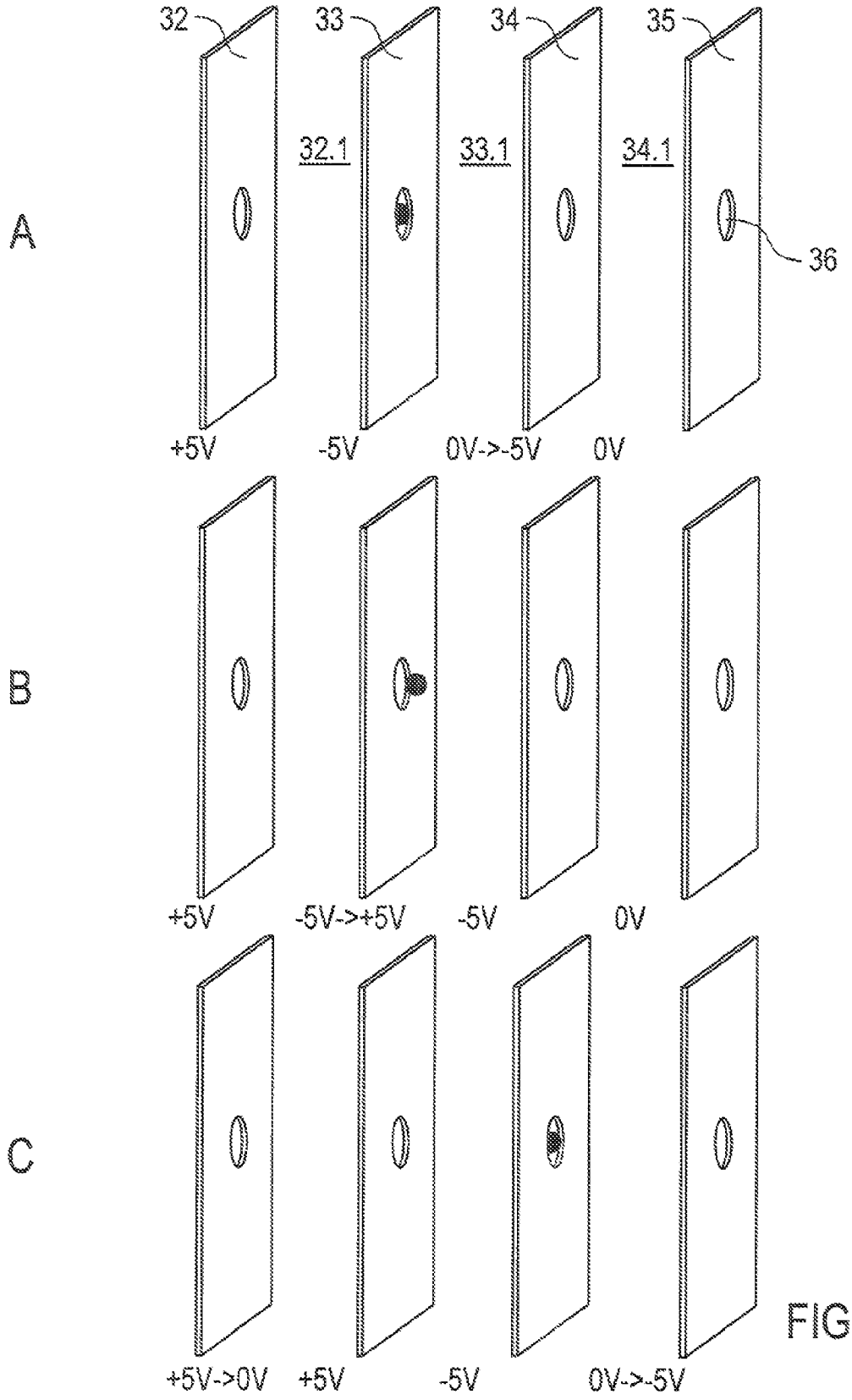
FIG. 2 shows a schematic illustration of a mass-selective acceleration of ions on plate electrodes.

A preferred control time scheme is illustrated in FIG. 2. FIG. 2 shows a part of the ion conductor with the electrodes 32, 33, 34 and 35 with electrode distances 32.1, 33.1 and 34.1. In this example positively charged target ions move from left to right.

In the situation illustrated by way of example in FIG. 2A, at first the repelling acceleration voltage (e.g., +5 V) is on the electrode 32 and the attracting acceleration voltage (e.g., −5 V) is on electrode 33. While the target ions are still at electrode distance 32.1 in front of electrode 33 the electrode 34 is already loaded with the attracting acceleration voltage (−5 V).

As soon as the target ions have moved through electrode 33 (FIG. 2B), the voltage of this electrode is switched to 0 V or, as shown, to the repelling acceleration voltage (e.g., +5 V). FIG. 2C corresponds to the situation in FIG. 2A, in which the target and ions have now been transported further by one electrode distance and have gained additional kinetic energy from the potential between the electrodes 33 and 34.

The control in time of the individual electrodes is coordinated in such a manner that only the target ions with the desired target mass from the dynamically progressing voltage field receive the maximal net energy gain. Other ions with, e.g., higher masses do not arrive until later at the particular controlled electrode and therefore do not experience the full gain of the kinetic energy as the target and ions do. Other ions with e.g., lesser masses cross the electrode distance more rapidly and are slowed down in the area of the following electrode distance. The desired time scheme is determined by a control computer contained in the control apparatus 70 as a function of the operating parameters of the mass spectrometer 100 and of the masses and charges of the sought target ions. The calculation of the time scheme for actuating the switching apparatus 73 is based on the principally known motion equations of charged particles in electrical fields.

As soon as the ion beam exits out of the ion conductor 30 the target ions are clearly distinguished from the other ions in as far as they have not already been deposited down on parts of the chamber 60 or evacuated. This makes possible the concluding energy separation with the energy filter apparatus 40. For example, a plate with an opening 41 in the middle is used as retardation lens on which a static, high voltage is applied. If, e.g., a braking voltage of +800 V is applied, only those positively charged ions with an energy above 800 eV per charge unit can pass the retardation lens whereas all other ions are retained. The braking voltage of the retardation lens is generally selected higher than the maximal energy of the uninteresting ions. Alternatively, e.g., two deflection plates can be used with which ions with higher energy (target ions) are deflected less strongly than the other, uninteresting ions. Immediately after the two deflections a mechanical window is present that lets only the interesting ions through.

In order to realize the described mass separation a rapid switching apparatus for the electrodes is used. The switching time is preferably selected in such a manner that that it is maximally approximately 10% of the flight time of the ions in the electrode distances between the electrodes.

An important advantage of the mass-selective transport, in accordance with the invention, of ions through an ion conductor is the achievable mass resolution. The mass resolution can be described by the ratio $M/\Delta M$, which is characteristic for the separability of ions with similar but not identical mass-charge ratios. At an acceleration potential in the source 10 of 50 V, a length of the drift zone 2 of 20 cm and an average voltage rise time of the second plate of 5 ns, values in a range of 204 to 2947 result for the cited ratio in the case of different isotopes (charge=±1), such as, e.g., $^{1}H$ or $^{208}Pb$ from calculations.

According to a modification of the above-described technique it is possible to determine different mass-charge ratios at the same time (so-called multi-collection). If the difference in mass is sufficiently large, two different masses can be selected from the same ion beam with a common reference time. For this the voltage control is adjusted in such a manner that the lighter mass has already traversed several electrodes before the heavier mass enters into the ion collector 30.

The features of the invention disclosed in the previous description, the drawings and claims can be significant individually as well as in combination for the realization of the invention in its different embodiments.

The invention claimed is:

1. A method for the mass-selective transport of ions, especially in a mass spectrometer, comprising the steps of:
- provision of the ions with an ion source apparatus at a predetermined reference time, the ions having a predetermined initial kinetic energy;
- moving the ions on a movement path on which a plurality of electrodes are arranged; and
- loading the electrodes successively with acceleration voltage pulses under the electrical field effects of which the ions experience a mass-dependent change of a speed, comprising the steps of:
  - generating a first acceleration voltage with a sign opposite a charge of the target ions;
  - continuously loading one of the electrodes approached by the target ions with the first acceleration voltage;
  - generating a second acceleration voltage with a sign the same as the charge of the target ions; and
  - continuously loading each time one of the electrodes from which the target ions depart with the second acceleration voltage, wherein:
- the speed of the ions along the movement path is determined by the initial kinetic energy, a mass-charge ratio of the ions and the electrical field effects at the individual electrodes,
- said successive loading of the electrodes is coordinated in time with the reference time, and
- the duration of the acceleration voltage pulses is changed during said successive loading along the movement path in such a manner that target ions with a pre-determined target mass are accelerated along the movement path.

2. A method according to Claim 1, wherein the loading of the electrodes with at least one of the first or second acceleration voltages comprises the steps of:
- generating the first or second acceleration voltage(s) with a voltage supply apparatus, and
- continuously switching either for the connection of the electrodes that the target ions approach or from which the target ions depart with the voltage supply apparatus.

3. A method according to claim 2, wherein in order to load with the first acceleration voltage the switching time and the duration of the connection to the voltage supply apparatus are selected in such a manner for every considered electrode that the considered electrode is loaded with the first acceleration voltage if the target ions are in an electrode distance in front of the considered electrode and the considered electrode is separated from the first acceleration voltage when, the target ions pass the considered electrode.

4. A method according to claim 2, wherein in order to load with the second acceleration voltage the switching time and the duration of the connection to the voltage supply apparatus are selected in such a manner for every considered electrode that the considered electrode is loaded with the second acceleration voltage if the target ions pass the considered electrode, and the considered electrode is separated from the second acceleration voltage when the target ions are in electrode distance behind the following electrode.

5. A method according to Claim 1, wherein the loading of the electrodes with the first and second acceleration voltages comprises the steps:

generating the first and second acceleration voltage(s) with a voltage supply apparatus, and continuously switching for the connection of the electrodes that the target ions approach and from which the target ions depart with the voltage supply apparatus.

6. A method according to claim 5, wherein in order to load with the first acceleration voltage the switching time and the duration of the connection to the voltage supply apparatus are selected in such a manner for every considered electrode that the considered electrode is loaded with the first acceleration voltage if the target ions are in an electrode distance in front of the considered electrode and the considered electrode is separated from the first acceleration voltage when the target ions pass the considered electrode.

7. A method according to claim 6, wherein the loading of the electrodes of the ion conductor with acceleration voltages is coordinated in time with the providing of the ions with the ion source apparatus.

8. A method according to claim 6, in which the transport and the detection are repeated for the mass-spectrometric examination of ions, and in which target ions with different masses are accelerated in the ion conductor and detected with the ion detector apparatus.

9. A method according to claim 5, wherein in order to load with the second acceleration voltage the switching time and the duration of the connection to the voltage supply apparatus are selected in such a manner for every considered electrode that the considered electrode is loaded with the second acceleration voltage if the target ions pass the considered electrode, and the considered electrode is separated from the second acceleration voltage when the target ions are in electrode distance behind the following electrode.

10. A method for the mass-selective detection of ions, comprising the steps of:

providing the ions to be examined with an ion source apparatus, transporting the ions with a method according to claim 1 through an ion conductor that contains a plurality of electrodes, which ions pass after the transport through the ion conductor through a braking field and/or a field with an electrostatic deflection, and detecting ions that were accelerated in the ion conductor with an ion detector apparatus.

11. An ion conductor for the mass-selective transport of ions, especially in a mass spectrometer, comprising:

an ion source apparatus arranged for providing the ions at a predetermined reference time;

a plurality of electrodes arranged along a movement path of the ions; and a voltage supply apparatus being adapted for generating acceleration voltage pulses and for loading the electrodes with the acceleration voltage pulses, under the electrical field effect of which the ions experience a mass-dependent change of speed comprising the steps of:

generating a first acceleration voltage with a sign opposite a charge of the target ions;

continuously loading one of the electrodes approached by the target ions with the first acceleration voltage;

generating a second acceleration voltage with a sign the same as the charge of the target ions; and continuously loading each time one of the electrodes from which the target ions depart with the second acceleration voltage, wherein:

the voltage supply apparatus comprises a switching apparatus for the successive loading of the electrodes along the movement path with the acceleration voltage pulses, the switching apparatus is adapted for varying the duration of the acceleration voltage pulses during the successive loading of the electrodes along the movement path, and a synchronization apparatus is provided for a timed control of the switching apparatus as a function of said reference time.

12. An ion conductor according to claim 11, wherein the voltage supply apparatus is directly connected to a synchronization apparatus for controlling the switching apparatus.

13. An ion conductor according to claim 11, wherein each of the electrodes has an areal shape from a conductive material and comprises a passage opening through which the movement path runs.

14. An ion conductor according to claim 13, wherein the electrodes comprise metallic plate electrodes.

15. An ion conductor according to claim 11, wherein at least 3 electrodes are provided.

16. An ion conductor according to claim 11, wherein an energy filter apparatus is provided for generating at least one of a braking field or a field with an electrostatic deflection, which energy filter apparatus is arranged along the movement path after the electrodes.

17. A mass spectrometer that is equipped with an ion conductor according to claim 11.

18. A mass spectrometer according to claim 17, wherein a detector apparatus is provided for detecting ions that pass the energy filter apparatus.

19. A mass spectrometer according to claim 18, wherein an acceleration apparatus is arranged between the energy filter apparatus and the detector apparatus.

* * * * *